United States Patent [19]

Bert

[11] Patent Number: 5,076,773

[45] Date of Patent: Dec. 31, 1991

[54] APPARATUS FOR PRODUCING THERMOPLASTIC YARNS

[75] Inventor: Paolo Bert, Cassano Magnago, Italy

[73] Assignee: Filteco S.p.A., Italy

[21] Appl. No.: 442,509

[22] Filed: Nov. 28, 1989

Related U.S. Application Data

[62] Division of Ser. No. 177,775, Apr. 5, 1988, Pat. No. 4,902,462.

[30] Foreign Application Priority Data

Apr. 6, 1987 [IT] Italy ..... 19990 A/87
Oct. 2, 1987 [EP] European Pat. Off. ..... 87810568.3

[51] Int. Cl.[5] ..... D01D 5/16

[52] U.S. Cl. ..... 425/66; 264/168; 264/210.8

[58] Field of Search ..... 264/103, 168, 210.8, 264/210.7; 19/0.25, 239; 425/72.2, 66

[56] References Cited

U.S. PATENT DOCUMENTS

| | | | |
|---|---|---|---|
| 2,985,503 | 5/1961 | Beckar | 264/103 |
| 3,077,004 | 2/1963 | Mummary | 264/103 |
| 3,099,064 | 7/1963 | Haynes | 264/103 |
| 3,107,140 | 10/1963 | Kurzaka et al. | 264/210.7 |
| 3,175,029 | 3/1965 | Whalon et al. | 264/103 |
| 3,259,681 | 7/1966 | Bull et al. | 264/210.3 |
| 3,295,170 | 1/1967 | Whitehurst | 19/0.25 X |
| 3,311,688 | 3/1967 | Schuller | 264/349 |
| 3,457,338 | 7/1969 | Lafevre | 264/103 |
| 3,621,088 | 11/1971 | Hatcher et al. | 425/71 X |
| 3,719,442 | 3/1973 | Schippers et al. | 425/72.2 X |
| 3,790,655 | 2/1974 | Cramton | 264/103 |
| 3,832,435 | 8/1974 | Bauer et al. | 264/168 |
| 3,947,538 | 3/1976 | Marshall et al. | 264/210.7 |
| 4,044,189 | 8/1977 | Arrowsmith | 264/210.7 |
| 4,225,299 | 9/1980 | Roberts | 425/72.2 |
| 4,265,849 | 5/1981 | Borenstein | 264/210.8 X |
| 4,369,155 | 1/1983 | Schilo et al. | 264/210.8 X |
| 4,504,432 | 3/1985 | Kamei et al. | 264/210.7 X |
| 4,530,809 | 7/1985 | Shindo et al. | 264/210.7 |
| 4,702,871 | 10/1987 | Hasegawa et al. | 264/211.14 X |
| 4,740,339 | 4/1988 | Bach et al. | 264/210.8 X |

FOREIGN PATENT DOCUMENTS

| | | | |
|---|---|---|---|
| 694324 | 9/1964 | Canada | 264/210.8 |
| 25812 | 1/1981 | European Pat. Off. . | |
| 28844 | 5/1981 | European Pat. Off. . | |
| 3304491 | 11/1983 | Fed. Rep. of Germany | 264/210.8 |
| 3323202 | 12/1983 | Fed. Rep. of Germany . | |
| 3508955 | 9/1986 | Fed. Rep. of Germany | 264/210.8 |
| 51-58522 | 5/1976 | Japan | 264/210.8 |
| 52-27817 | 3/1977 | Japan | 264/210.8 |
| 2105641 | 3/1983 | United Kingdom | 264/210.8 |

OTHER PUBLICATIONS

Fleissner advertisement, *International Fiber Journal*, Jun. 1990, p. 10.

*Primary Examiner*—Jay H. Woo
*Assistant Examiner*—Robert B. Davis
*Attorney, Agent, or Firm*—Wigman & Cohen

[57] ABSTRACT

Continuous polypropylene multifilament yarns are made by melt spinning and stretching in an integral process; a sufficient number of filaments for forming at least 8 continuous filament yarns each consisting of at least 10 filaments are melt spun through a spinneret (11) at a speed of at least 400 m/min into a vertical air quenching zone or shaft (12) for solidification; the filaments are arranged to form a substantially planar array of parallel and mutually distanced yarn strands; then, the filaments are stretched to achieve substantial orientation by passing the yarn strands, while maintaining them in the array, over peripheral surface portions of a sequence of rotating cylinders (141, 142, 143, 144) having parallel axes of rotation, each strand (S) passing over surface portions along a discrete path which is substantially defined by a plane intersecting perpendicularly with the parallel axes of the cylinders; each strand is in frictional contact with the peripheral surface portions for a total contact path length of from 1000 to 6500 mm and at least 50%, preferably 75–100%, of the path length of frictional contact are provided on a total number of from 2 to 6 and preferably 4 large diameter cylinders; the yarn strands are wound as a poduct at a speed of at least 1000 m/min, e.g. at about 2000 m/min.

57 Claims, 4 Drawing Sheets

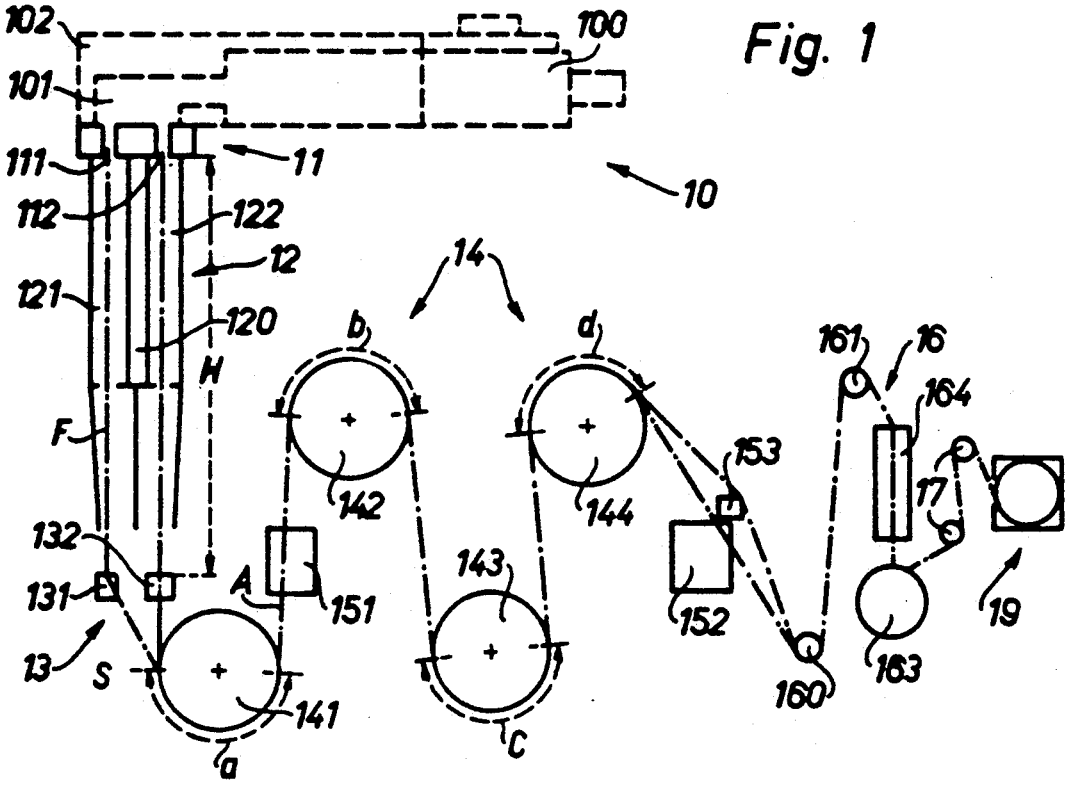
Fig. 1
Fig. 1A
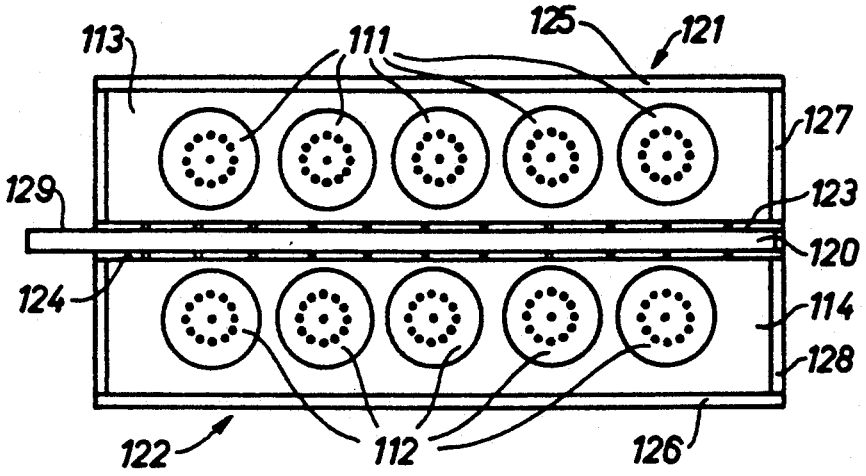

APPARATUS FOR PRODUCING THERMOPLASTIC YARNS

This is a divisional of co-pending application Ser. No. 07/177,775 filed on Apr. 15, 1988, now U.S. Pat. No. 4,902,462.

BACKGROUND OF THE INVENTION

The invention generally relates to the production of polypropylene yarns and specifically to a method of making such yarns by melt spinning.

Melt spun polypropylene has been in commercial use for monofilaments, such as fishing lines, and staple fibers, such as carpet yarns. However, attempts to introduce polypropylene filament yarns into the apparel market have met with problems to the extent that quality fine denier yarns made of nylon or polyester are the rule while those made of propylene, if available at all, are the exception. Considering the lower costs of polypropylene as well as its unique properties, such as mechanical strength combined with thermal and chemical stability as well as its favorable ability to transfer moisture in the vapor phase, this is surprising since polypropylene would seem to provide for very desirable textile yarns.

The crucial problem, however, is that the processing technologies developed for polyesters and polyamides, notably the preoriented yarn (POY) methods, are not suitable at all for commercial polypropylene processing. This lacking transferability of established method and apparatus means for production of continuous yarns is believed to be due essentially to the fact that molten polypropylene behaves as a non-Newtonian liquid exhibiting structural viscosity phenomena that cause what is termed "draw resonance" or "spinning resonance" as illustrated, for example, in FIGS. 4 and 5 of EP—A—0 025 812 or US—A—4,347,206 incorporated herein by way of reference.

Briefly and in exaggeration, polypropylene not only exhibits dye-swelling upon extrusion but upon drawing-down from the swellings formed at the underside of the spinneret produces a filament with a non-uniform thickness in the manner of a string of linked sausages. Various prior art methods have been aimed either at modifying the polypropylene material or at specific methods (e.g. FR Patent No. 1,276,575, EP—A—0 028 844, DE—A—33 23 202) and it appears that acceptable results can be achieved best when semi-finished filament yarns are made in a first process by yarn producers and then textured and/or drawn to substantial orientation as required for most commercial uses of the yarns in a second separate process, e.g. by the yarn users.

However, integral methods, i.e. those starting from the unspun polymer and producing final polypropylene yarns composed of a plurality of continuous and substantially oriented filaments by melt spinning and stretching on a single production unit, have suffered either from low processing speeds of typically below 500 meters per minute or—when operable at acceptable production speeds of above 1000 meters per minute—from severe limitations as to the number of yarns that can be obtained per stretching installation unit. Consequently, production output per investment unit has not been satisfactory, or a multiplicity of stretching installation units had to be used and maintained.

Accordingly, it is a main object of the invention to provide for an integral method where a multitude of yarns, say 8 to 16 or more, can be obtained on a single stretching unit at speeds of above 1000 m/min yielding final product yarns that could either be in the form of fully oriented continuous yarns (FOY) and/or in the form of bulked continuous yarns (BCY) with yarn and filament deniers both for apparel use or any other yarn application where the unique properties of polypropylene provide an improved product.

A further object of the invention is an apparatus specially adapted for carrying out the novel method.

SUMMARY OF THE INVENTION

These and further objects apparent from the following description will be achieved according to the present invention by a method of producing polypropylene yarns composed of a plurality of continuous and substantially oriented individual filaments by melt spinning and stretching them in an integral process, characterized by (A) simultaneously extruding a sufficient number of said individual filaments for forming at least 8, preferably at least 10 and typically from 12 to 16 continuous multifilament yarns, each consisting of at least 10 individual filaments, e.g. of about 30, 60 or more, at an extrusion speed of at least 400 meters per minute, preferably at least 600 m/min, into an essentially vertical air quenching zone for solidification of said filaments;

(B) arranging the filaments to form a substantially planar array of parallel and mutually distanced (e.g. 5 to 50 mm distances) yarn strands in a number corresponding to step (A);

(C) together stretching the strands to achieve the required substantial orientation, e.g. at typical draw ratios of $1 \div 1$ to $1 \div 3$, by passing said yarn strands, while maintaining them in said planar array, over peripheral surface portions of a sequence of rotating cylinders having parallel axes of rotation; each strand passing over said surface portions along a discrete path which is substantially defined by a plane intersecting perpendicularly with said parallel axes of said cylinders; each strand being in frictional contact with said peripheral surface portions for a contact path length of from 1000 to 6500 mm, preferably from 1000 to 4000 mm and most preferably from 1500 to 3000 mm; at leat 50% and preferably 675 to 100% of said contact path length being provided on a total number of from 2 to 6, preferably from 3 to 5 and most preferably 4 cylinders;

(D) optionally providing a texturizing and/or entangling step after said drawing step (C);

(E) preferably providing a first and a second group of rupture control means for each of said yarn strands at mutually distanced positions of said discrete path;

(F) and finally winding said yarn strand obtained as product, e.g FOY or BCY, e.g. with a typical yarn denier range of from 40 to about 800 and 1.5 to 15 den per filament, at a speed of at least 1000 m per minute, e.g. 2000 m/min or more.

The apparatus for use in this method comprises a number of conventional elements i.e.

(a) a spinneret means, e.g. a conventional spinning plate or multi-spinneret frame connected with an extruder and pumps; the spinning plate or the spinnerets have a plurality of openings for melt spinning of a molten polypropylene composition;

(b) vertical shaft or chute means for cooling or quenching and solidifying the molten polypropylene after emergence from the spinneret means to form a plurality of filaments;

(c) means to combine the monofilaments to form at least one multifilament yarn strand;

(d) stretching means to substantially orient said filaments of said at least one yarn strand;

(e) winding means;, the apparatus being characterized in that the spinneret means (a) has a sufficient number of openings to form at least 8 yarns, e.g. 10, 12, 14, 16 or more yarns, each comprising at least 10 filaments and typically comprising about 30, 60 or more continuous filaments; the vertical shaft means have a length sufficient to provide for a free path length of the filaments after emergence from the spinneret means and prior to first contact with a mechanical filament-contacting means of at least 2.5 meters, e.g. 3–5 meters or more, while a free path length of above 7.5 m is feasible but not generally preferred; the stretching means are formed by a sequence of rotating cylinders having parallel axes of rotation (i.e. with parallel cylinder surfaces for engagement with the strands) arranged to provide for a path length of frictional contact with the yarn strands of from 1000 to 6500 mm, preferably of from 1000 to 4000 m and most preferably from 1500 to 3000 mm, and wherein at least 50% and preferably 75 to 100% of the length of frictional contact are provided on a total number of from 2 to 6, preferably from 3 to 5 and most preferably 4 cylinders.

Thus, the invention combines the element of rapid spinning of a sufficient number of filaments for a large number of yarns with the element of stretching the resulting yarn-forming groups of filaments together, i.e. in common, on a small number of large cylinders along parallel and discrete or individual pathways in which the length of frictional contact is within specified limits and provided, at least predominantly, by the large cylinders.

BRIEF DESCRIPTION OF THE PREFERRED EMBODIMENTS

When operating the inventive method, the cylinders will generally be maintained at a predetermined and generally elevated temperature as is conventional per se; also, in a manner known per se, the cylinders provide for incrementation of speed as needed for a particular draw ratio.

It has been observed that the occurrence of yarn breaks tends to be very low when using the inventive method and apparatus; While not wishing to be bound by any specific theory, it is believed that prolonged interfacial contact between cylinders and filaments tends to improve uniformity of frictional interaction and/or heat transfer. For practical purposes, it is preferred that most or all cylinders used for stretching according to the invention will have equal diameters; cylinder diameters should be at least 300 mm and preferably at least 400 mm; diameters of more than 1000 mm would be operable but are not generally preferred for practical purposes. Length (=width) requirements of the cylinders depend upon the number of yarn strands that are commonly stretched on a given cylinder, and the minimum distance required or desired between parallel strands. Typical strand distances are in the general range of from 5 to 50 mm, e.g. 8–15 mm, and a typical cylinder length for simultaneous stretching of 16 strands will be in the range of from 200 to 500 mm.

An additional advantage of the large-cylinder-stretching approach with a plurality of yarn strands is that if yarn rupture does occur its control, removal and repair can be achieved in a relatively simple manner as long as reasonable distances are provided between adjacent cylinders.

Surface materials and surface conditions do not seem to be overly critical; stainless steel surfaces, chromium platings and the like structural metals are suitable.

A total number of 4 cylinders for stretching according to the invention is preferred for reasons of simplicity of construction and operation. For example, when providing a preferred contact path length of from 1500 to 3000 m on a total of 4 stretching cylinders having equal diameters in the range of from 400 to 500 mm, the first cylinder "upstream" (i.e. closest to the spinneret) and the subsequent or second cylinder will be rotated by a conventional drive at a relatively "low" peripheral speed which depends, of course, upon the extrusion speed but may typically be within the range of from 600 to 1000 m/min; while the first two cylinders have a common speed, this does not necessarily imply identical speeds; for example, it may be advantageous to operate the second cylinder of the low-speed first group at a peripheral speed that is somewhat higher than that of the first cylinder, e.g. by 5 to 15%.

The second cylinder group in the preferred arrangement just mentioned operates at a common "high" peripheral speed, e.g. 1200 to 2200 m/min depending upon the peripheral speed of the first cylinder group and the desired draw ratio that, typically, may be in the range of from $1 \div 1$ to $1 \div 3$. Again, a "common" speed of the second cylinder group does not mean identical speeds, and the second cylinder of the second group (i.e. the last cylinder of the preferred stretching embodiment just mentioned) may have a somewhat higher peripheral speed than the immediately preceding first cylinder of the second group.

Depending upon the desired product, a texturizing and/or entangling stage may be provided and conventional methods or devices for use in processing of polypropylene filament yarns can be used; in this embodiment additional cylinders will generally be required before and after the texturizing and/or entangling step, notably for bringing the textured and/or entangled yarn from a holding position, such as in the groove of a perforated suction drum, to the speed of the winders.

Generally, the winding speed will be at least 1200 m/min but higher winding speeds, say 2000 m/min or more, will be used for many purposes of the invention.

Since both the texturizing and/or entangling step as well as winding of the product yarns are conventional per se and can be carried out with commercially available elements, this aspect need not be discussed in more detail.

While yarn rupture control methods and apparatus means are known as well, the invention provides a new aspect thereof as regards stretching of a large number of yarns on a single stretching device at speeds of substantially above 500 m/min. Specifically, since yarn ruptures can never be totally excluded, simple and effective rupture control and repair is an important additional aspect of the invention.

First, as mentioned above, the inventive concept of large-cylinder-stretching of a yarn array, i.e. 8 or more yarns, along discrete pathways that are parallel with each other and perpendicular relative to the rotation axes of all stretching cylinders is based upon large cylinder surfaces provided essentially on but a few large cylinders. With sufficient distances between adjacent cylinders, e.g. typical distances of at least half the mean cylinder diameter of any two adjacent cylinders of the stretching means, the stretching device is easily accessible to the operator in charge of yarn rupture control so that repair and re-feeding of a broken strand presents no problems.

Further, according to a preferred embodiment, first and second rupture control means are provided near the start (e.g. between the first large diameter cylinder, i.e. that next to the spinneret, and the second large diameter cylinder), as well as near the end (e.g. after the last large diameter cylinder of the stretching means) of said path length of frictional contact for each of said yarn strands. Additional smaller cylinders may be provided for the stretching stage, e.g. between the large diameter cylinders, but this is not preferred; in general, the large diameter cylinders alone are sufficient for yarn path deflection within the stretching stage.

Few and large diameter cylinders for together stretching the filaments combined with rupture control near the start and near the end of the stretching means provide for a particularly effective rupture control and repair even when simultaneously stretching 10, 12 or 16 parallel yarns on a single stretching unit at speeds of 1000 m/min or more in a single stretching stage according to the invention and effected on a sequence of but a few large cylinders.

According to the invention, the second rupture control, typically a yarn detector, would sense a discontinuity or absence of yarn passage and activate a small cutter provided for this and any strand in the first rupture control means. A suction opening associated with each yarn cutter would now receive the freshly cut leading edge of the broken strand. A signal means coordinated with the second and/or the first rupture control means will be triggered upon rupture of any given strand, of course, to inform the operator of a strand rupture and of the position of the strand. Then, the operator will activate a mobile aspirator, direct it to the suction opening into which the broken strand passes after operation of the cutter, and manually cut the strand so that the new leading edge of the broken strand will be sucked into the mobile aspirator. Then, without stopping production of the unbroken strands, the operator can easily re-insert the line of the previously broken strand into the corresponding pathway way which is recognizable because of the incompleteness of the array and is accessible on the large cylinder surfaces.

After re-insertion of the broken strand into and through the optional texturizing and/or entangling stage is completed, the re-fed yarn is passed from the mobile aspirator to the winder and/or a yarn-mending device cooperating therewith.

Yarn rupture control of this type including various forms of yarn aspirators, yarn detectors etc. are commercially available and need no further explanation except as regards the number of strands. Since at least 8 and typically 16 strands per stretching device may require individual control in the inventive method, combinations of a sufficient number of modular units, e.g. one cutter/aspirator and yarn detector module for each yarn, are required. Further, in order to facilitate yarn feeding upon start-up or upon yarn rupture repair, a preferred embodiment of the first and/or second rupture control means provides for automatic strand feeding and includes a number of yarn guide slots substantially corresponding with the array of strands and arranged in an elongated bar extending over the width of the yarn array. An elongated and displacable slide bar is provided for guiding some or all strands of the array along a path portion that does not pass through the slots but beyond them. The slide bar will be in this position only for start-up or yarn repair and is withdrawn when the complete array passes on top of the slide bar so that all strands will again be put into the slots of the slide bar.

DETAILED DESCRIPTION OF THE PREFERRED EMBODIMENTS

The invention will now be discussed in more detail with reference to the enclosed drawings in which:

FIG. 1 represents a diagrammatic side view of an installation for carrying out the method according to the invention;

FIG. 1A is a plan view of the spinneret means of the apparatus of FIG. 1;

Figure 1B:
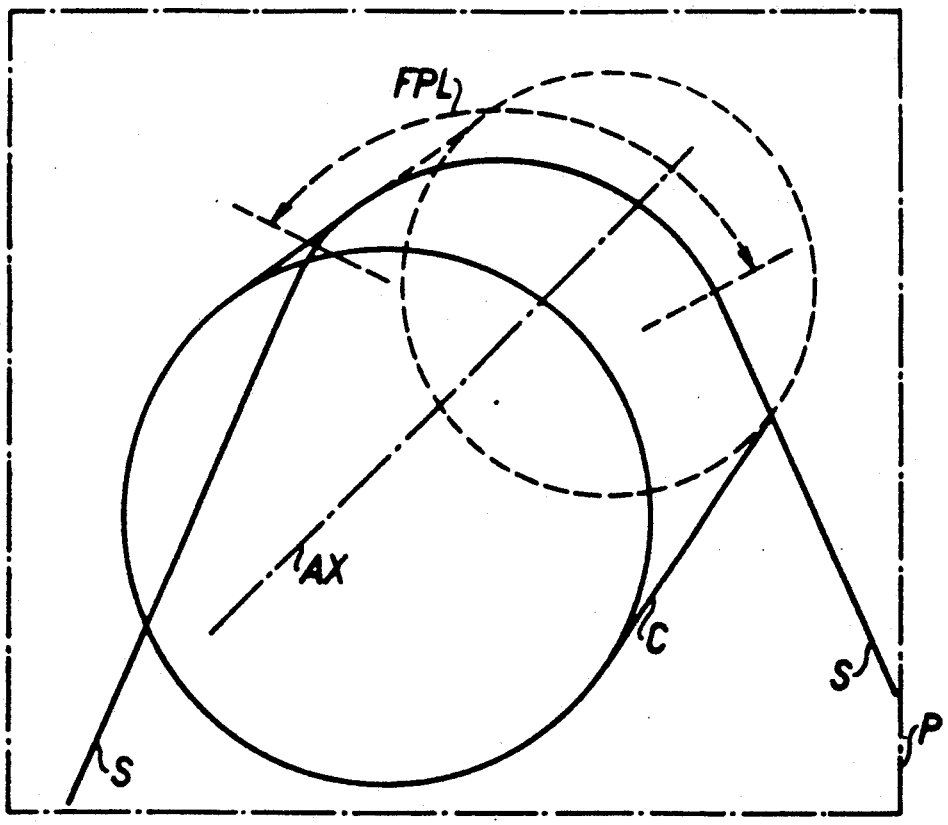
FIG. 1B is a diagrammatic perspective view of one of the stretching cylinders of the apparatus shown in FIG. 1.

Polypropylene suitable for use in the present method is obtainable commercially for melt spinning of continuous multifilament yarns, e.g. the products sold by Himont, Italy, under the registered trademark MOPLEN; commercial spinning grade pellet products containing or not the usual additives are preferred or, in other words, neither particularly critical substance parameters nor special formulations are generally required for practicing the inventive method; typical examples are polypropylene homopolymers having a melt index (cf. ASTM D 1238/L) of at least about 10 dg/min, e.g. from 10 to 12 dg/min or more, e.g. up to 18 dg/min at 230° C. and 21.6N; a flexural modulus of elasticity (ASTM D 790) of at least about 1500 N/mm$^2$, e.g. about 1700 N/mm$^2$; a tensile strength at yield (ASTM D 638) of 35 to 40, e.g. 38 N/mm$^2$; an elongation at yield (ASTM D 638) of about 10%, e.g. 11%; and a Vicat softening point (ASTM D 1525) of 150–160° C., e.g. 155° C. Molecular weight distribution values (i.e. the ratio of the weight average molecular weight to the number average weight) of from about 5 to 6 have been found to be suitable for the subject method. Colored master batch materials can be used and/or pigments and other additives can be added prior to use herein.

Generally, polypropylenes for use in the present invention should be capable of being melt spun with commercially available extruders and spinning pumps at extrusion speeds of at least 400 m/min through the holes of a spinning plate or spinneret having diameters required for spinning multifilaments in the typical denier range of from 1 to 15 den per filament, typical yarn deniers being in the range of from 40 to 800 den. Hence, suitable polypropylenes must be capable of "substantial orientation" in the sense that filaments obtained by extrusion and drawing-down are able to achieve molecular orientation by stretching to near the limit of plastic flow. Generally, filaments that have been substantially oriented will show a substantially reduced or "low" elongation if compared with the "drawn-down" filaments obtained after solidification of the melt spun filaments prior to the application of substantial stretching. Typically, substantially oriented filaments will have an individual elongation at room temperature of less than about 250%; frequently, the final yarn obtained according to the inventive method will have even less elongation, depending, however, whether FOY or BCY products are made, i.e. whether or not a texturizing and/or entangling step is applied to the yarns after stretching.

Thus, the term "substantial orientation" includes "substantially full orientation" as well as an approximation thereto that is sufficient for normal end uses of the yarns.

A first essential feature of the inventive method relates to the number of yarns being produced simultaneously with a single stretching means, or the number of "yarn strands" that are being processed according to the invention; in this context, a "filament" is a "fiber" of infinite length, and "individual filament" refers to one of a plurality of filaments forming a yarn or "yarn strand" which latter term refers to a group of individual filaments which are stretched as a single group or unit; such strands may be identified when practicing the invention by a consecutive number of from 1 to 8, 10, 12, 14 or 16 depending upon the actual number of strands or yarns actually run in the inventive method per each stretching unit.

Figure 1C:
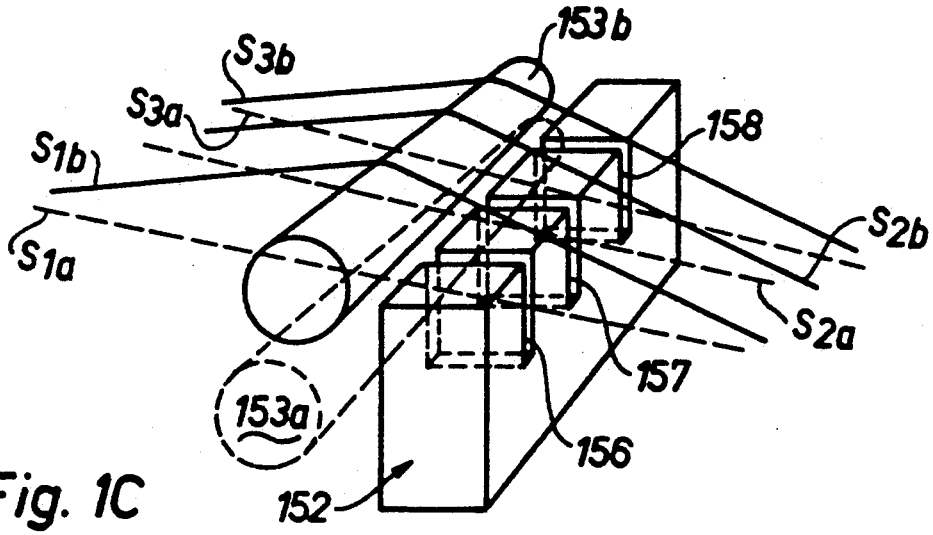
FIG. 1C is a simplified perspective presentation of a guide bar with coordinated slide bar for deflecting and re-feeding a yarn strand array through a first or second rupture control means.

As is conventional, each yarn or strand of a multifilament yarn will include a multiplicity of typically about 30, 60 or even about 120 individual filaments per yarn and it is assumed herein that when referring to a multifilament yarn, at least 10 filaments are assumed to be present in the yarn. This is a matter of practice rather than theory since normal yarns will contain substantially more than 10 filaments. Hence, the first essential portion of an apparatus for carrying out the inventive method such as depicted in FIG. 1 will comprise a spinneret means 11 that may be a fixed spinning plate or, preferably (cf. FIG. 1A), is formed by one or more frame plates 113, 114 each comprising a number of exchangeable, e.g. circular spinneret inserts 111, 112 in line with the filament denier and/or the number of filaments per yarn and/or the cross-section of the filaments desired for the final yarn.

While it is important for the inventive method that a sufficient number of filaments are melt spun to permit formation of at least 8 yarns or yarn strands per stretching means or unit, it is not believed to be of importance whether these strands pass through a common shaft means 12 or whether the shaft means is composed of more than one chamber (two chambers 121, 122 being illustrated in FIGS. 1 and 1A); also, it is not believed to be essential whether or not the extrusion openings or holes of the spinning means are already grouped in accordance with the yarn strands to be formed or whether they have no group orientation during solidification. Strand collecting means 131, 132 formed by a line of hooks or ears will normally be used for collecting the required number of filaments into each strand.

The "extrusion speed" is another essential feature of the invention insofar as it determines the minimum production speed which, according to the invention, is at least 1000 meters per minute. The term "extrusion speed" is used synonymously with "melt spinning speed" and does not necessarily refer to the speed of the molten mass upon emergence from the spinneret but rather to the speed of formation of solidified but essentially non-oriented filaments. Generally, the inventive method operates with an extrusion speed of at least about 400 m/min. The shaft means 12 or the shaft portions 121, 122 together form the essentially vertical "air quenching zone" in the sense that the heat exchange medium is gaseous rather than liquid, and that the temperature of the gaseous quenching medium is substantially lower than the temperature of the molten mass that emerges from the spinning holes of the spinneret; hence, the term "air" is intended to include any practical gas or gaseous mixture that can be maintained without undue problems at a quenching temperature of typically in the range of from about 0 to about 50° C. with a preferred temperature in the range of from about 10 to about 30° C. Forced, i.e. accelerated yet essentially laminar, passage of air through shaft 12 or its portions is generally preferred, as is temperature control. Whether or not artificial cooling is needed may depend upon the ambient climate.

In order to feed a suitable supply of molten polypropylene to the spinneret means 11 according to the invention, conventional extruder means 10 can be used. For example, an extruder 100 of 1×75 mm screw diameter can be used for production of yarns of 40 to 250 den while a screw diameter of 1×90 mm would be suitable for yarns in the 150 to 800 den range when a total of 16 to 32 yarns is produced from the output of extruder 100. As is conventional, a spinning pump 101 and a heating means 102 are generally used to ascertain a sufficient and suitably heat controlled supply of molten polypropylene to the spinneret means 11.

FIG. 1A is a semi-diagrammatic plane view of the spinneret end as viewed from a shaft 12 which in its upper part is formed by a pair of parallel cooling chambers 121, 122 encompassed by air-permeable inner and outer wall pairs 123, 125 and 124, 126, respectively, and supplied with a substantially laminar stream of cold or cooled air via conduit 129. Side walls 127, 128 need not be permeable to air but it is preferred that the front walls 125, 126 can be removed easily for access to the spinneret ends 111, 112.

The intensity of cooling or quenching of the at least 8 strands to be formed at the spinneret or, in any case, when forming the strand array on the first cylinder 141 as explained in more detail below will depend upon the passage of molten polypropylene mass per time unit into and through the air quenching zone formed by or in shaft means 12. However, it is generally preferred according to the invention that the vertical length or "height" H of the shaft means as measured from the lower end of the spinnerets 111, 112 to the first point of contact with a mechanical yarn contacting means should be at least 2.5 meters, e.g. about 3 to 6 meters, but essentially for practical reasons not substantially above about 7.5 meters.

A next essential step of the inventive method is formation of a "planar array" A of the yarn strands S; to this effect, filaments F are collected or assembled to form strands which, normally, are formed by filaments in equal numbers, e.g. each strand containing 64 filaments; such groups may be preformed by the spinneret openings 111, 112 but "hooks" or "ears" arranged in the form of transverse guide bars 131, 132 for the strands from each shaft portion 121, 122 are preferred. The collected strands in which the filaments are densely packed close to each other are now directed onto the surface of the first cylinder 141 of stretching means 14 according to the invention to form the "strand array". Such an array is characterized by common parallel alignment of all strands that are to be stretched in a stretching unit according to the invention; each strand runs along an individual path since the strands are distanced from each other, e.g. by distances of from 0.5 to 50 mm or more depending upon the number of strands and the axial length of the cylinders; a generally equidistanced array may be preferable but equidistance is not a critical requirement as long as all paths are parallel and substantially maintained in this array during the stretching operation, i.e. until substantial orientation of the filaments has been achieved. This requires that the stretching cylinders have substantially parallel axes of rotation such that each strand will pass through the stretching stage in a plane that intersects perpendicularly with the rotation axis of any cylinder. This is illustrated diagrammatically in FIG. 1B in which the frictional path length FPL of strand S on cylinder C is defined essentially by a plane P which intersects perpendicularly with the rotation axis A of cylinder C, and the length of contact between strand S and cylinder C.

As briefly mentioned above, it is believed to be essential for the inventive method that the length of frictional contact of each strand with the parallel stretching cylinders, e.g. the sum of a, b, c and d in FIG. 1 is within the range of from 1000–6500 mm, preferably 1500 to 4000 mm and notably between 2000 and 3000 mm, but that this frictional contact length also should be provided at least predominantly (i.e. more than 50%) and preferably essentially (i.e. from 75 to 100%) on a small total number of cylinders which number is between 2 and 6; a total of 3 to 5 cylinders may be used but an even number of cylinders is preferred. While 2 cylinders could be sufficient, the cylinder diameters required might not be practical; a total number of 4 cylinders is suitable and preferred as shown in FIG. 1 where the cylinders 141, 142, 154, 144 contribute substantially equal portions a, b, c and d of the total frictional contact length.

Generally, the first cylinder 141 will rotate at a lower peripheral speed than the last cylinder 144 and the difference of peripheral speeds will be commensurate with the required or desired draw ratio; each of the cylinders is connected with a drive (not shown) and provided with heat control or heating means such that a predetermined and substantially constant surface temperature in the range of from 80° to 130° C. can be maintained on each cylinder.

Peripheral speeds of the first cylinder 141 or the first cylinder pair 141, 142 of from 600 to 1000 m/min are typical while peripheral speeds of from 1200 to 2000 m/min or more would be typical for cylinders 143, 144. Small differences of peripheral speeds, say about 10% between cylinders 141 and 142, on the one hand, and between 143 and 144, on the other hand, may be advantageous. In general, "frictional contact" is assumed to exist if the amount of "slippage" (i.e. yarn speed is smaller than the speed of the contacting cylinder) should be lower than 20%, preferably not substantially more than 10%. While special coatings or surfaces of the stretching cylinders, e.g. ceramic or glass surfaces are not excluded if frictional contact can be maintained, conventional cylinder surfaces of stainless steel, chromium (e.g. as electroplating) are satisfactory for many purposes of the invention.

Preferably, a first yarn rupture control means 151 is provided between the first and the second cylinder, i.e. near the start of the stretching stage, while a second rupture control means 152 is provided near the end of the stretching stage, e.g. down-stream of cylinder 144. A sliding rod or bar 153 may be used on either or both yarn rupture control(s) as shown diagrammatically in FIG. 1C. Slot bar 153 is shown for simplicity with but three slots 156, 157, 158 for passage of three strands S-1, S-2 and S-3. When in normal operation, each strand passes through its proper slot provided, for example, with conventional yarn detecting means (not shown). For startup of the apparatus or for re-feeding a broken strand slide bar 153 is moved from below into the position shown in full lines in 153*b*. After placement of all strands in accordance with the array used in a given apparatus and with a given strand number so that the strands pass above the slots as indicated by S-1*b*, S-2*b* and S-3*b*, the slide bar is now withdrawn or moved into position 153*a* (broken lines) and all strands will then be guided into and through their corresponding slots automatically along the normal pathways S-1*a*, S-2*a*, S-3*a*.

When the apparatus shown in FIG. 1 is to produce bulked and/or texturized yarns the strands are passed through a texturizing and/or entangling device 16, e.g. a number of hot air texturizing jets 164 onto a collector drum 163 from which they are drawn off via auxiliary rollers 17. Further auxiliary rollers 160 and 161 may be used to guide the strands into device 164.

Figure 2A:
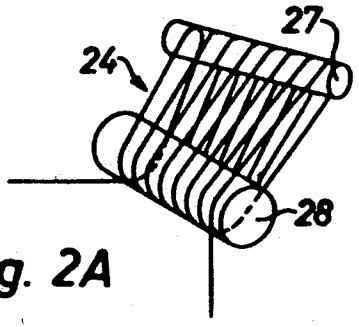
Fig. 2A PRIOR ART
FIG. 2A is an enlarged view of stretching rollers used in the prior art apparatus of FIG. 2.
Figure 2:
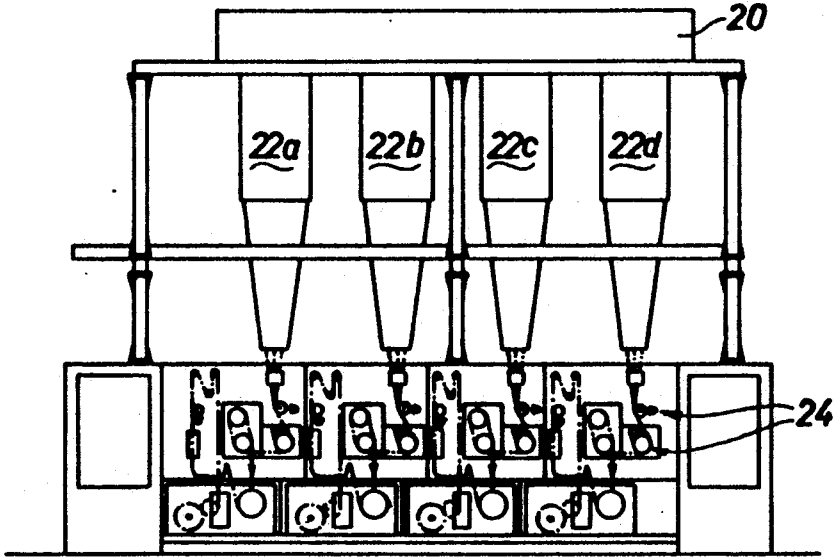
FIG. 2 is a semi-diagrammatic side view of a prior art integral processing plant for producing continuous polypropylene multifilament yarn by melt spinning and stretching.

FIG. 2 illustrates a prior art integral production apparatus for melt spinning and drawing polypropylene multifilament yarns. As are apparent, a large number of shafts 22*a* to 22*d* is needed since prior art stretching devices 24 of the spiral path type consisting of two rollers with small diameters and an angular arrangement of the axes of rotation of the two rollers relative to each other were believed to be the best for high speed integral operation. Generally, at least two such or similar stretching devices with small diameter cylinders of typically 200 mm or less were needed for each shaft, and parallel pathways of a multiplicity of yarn strands were impossible to achieve on such prior art machines. An enlarged view of a spiral-path stretching device is shown in FIG. 2A.

Figure 3:
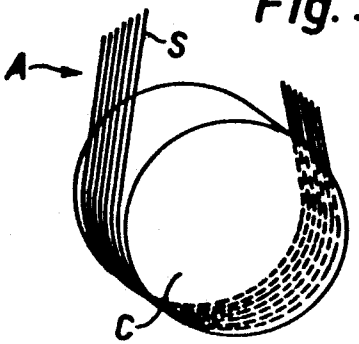
Fig. 3 PRIOR ART
FIG. 3 is a diagrammatic view of a large stretching cylinder used in the inventive method with a multiplicity of parallel yarns while being stretched together.

As is clearly seen from the comparison with FIG. 3 showing a large diameter cylinder C with an array A of 11 strands S in parallel alignment as taught according to the invention, the use of few but large diameter cylinders, in addition to the other advantages discussed above, provides for simultaneous passage of a multiplicity of yarns through a stretching unit while prior art requires one group of stretching devices per each shaft or module while generating but one or only very few strands per shaft and stretching unit.

Figure 4:
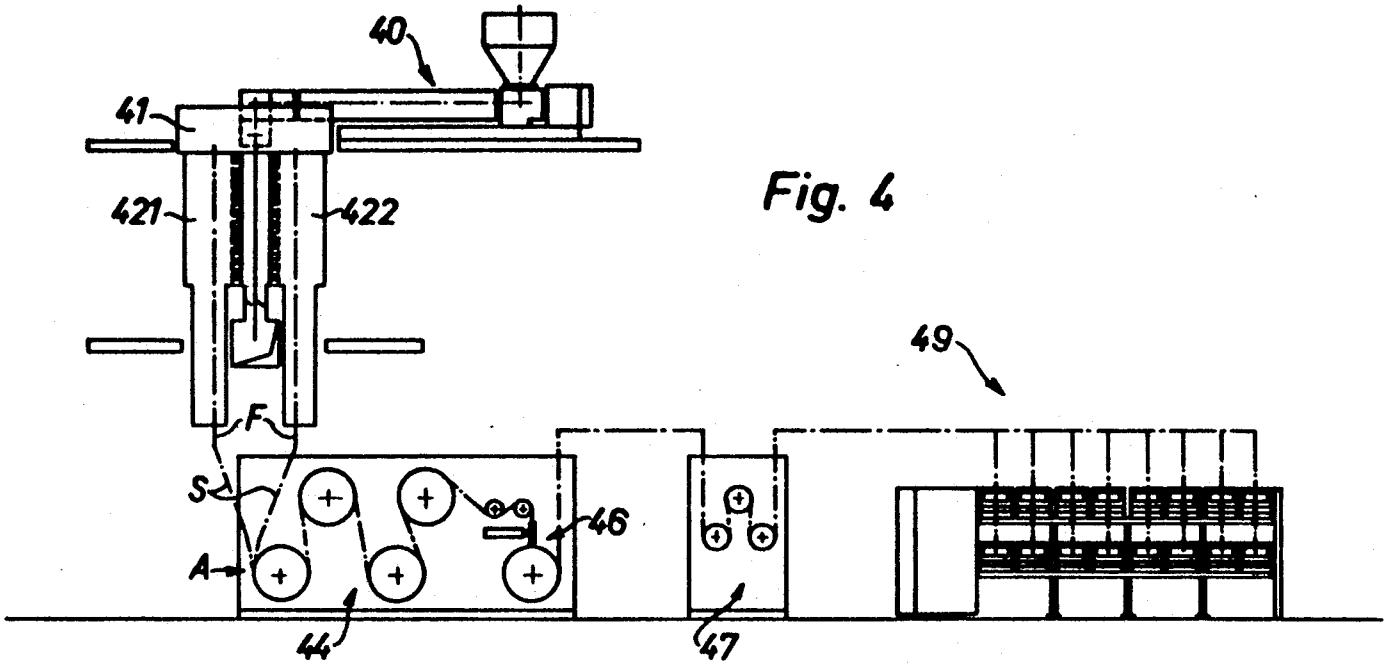
FIG. 4 is a semi-diagrammatic side view of an apparatus for carrying out the method of the invention.
Figure 4A:
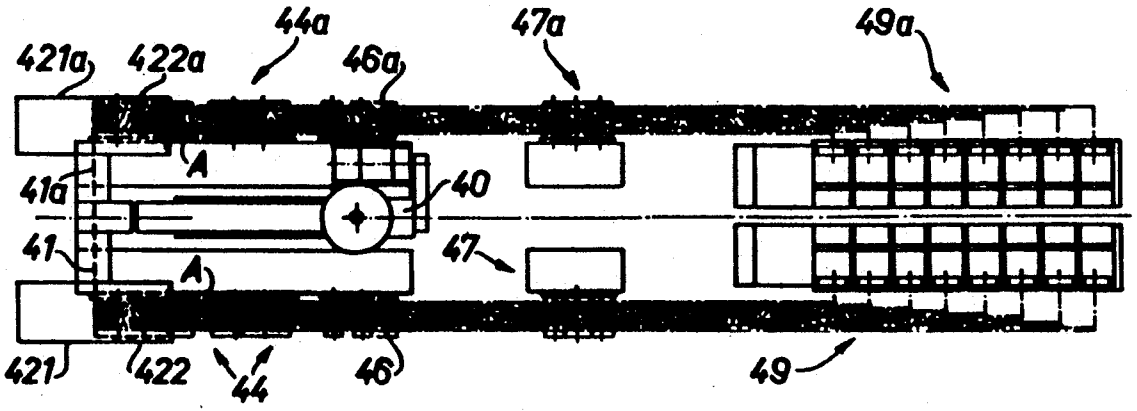
FIG. 4A is a top view of the apparatus of FIG. 4.

FIGS. 4 and 4A show a semi-diagrammatic presentation of an apparatus according to the invention in side view and top view. The side view shows essentially the same elements as FIG. 1, namely a pair of shaft portions 421, 422 supplied from an extruder 40 via spinneret 41 to produce filaments F that are collected to form strands S and are stretched in the form of a planar array A by means of a stretching unit 44 composed of 4 substantially equal stretching cylinders of at least about 400 mm diameter as explained above; the oriented yarn strands are then passed through a texturizing and entangling device 46 and via auxiliary rollers 47 fed into a winding apparatus 49.

However, as seen from the top view of FIG. 4A, the apparatus shown in FIG. 4 actually is "twinned" in that a single extruder 40 supplies a pair of spinnerets 41, 41*a*, a pair of double shafts 421, 422, 421*a*, 422*a*, a pair of stretching units 44, 44*a*, a pair of auxiliary rollers 47, 47*a* and also a pair 49, 49*a* so as to produce typically 30 continuous filament yarns or more at speeds of typically at least about 2000 m/min as a continuous product stream in an integral operation from the common extruder 40.

Yarn rupture control means as explained above in connection with FIG. 1 have been omitted in FIG. 4 but for simplicity of presentation and will, of course, be used in practice to provide optimum yarn rupture control at high speed multistrand production of polypropylene yarns according to the invention.

In sum, the invention provides for extremely effective and compact means for economic production of high quality polypropylene continuous filament yarn products including those suitable for garment use.

Suitable modifications can be made to the method and apparatus described herein. While preferred embodiments have been explained in some detail, the invention is not limited to these embodiments but may be practiced within the scope of the following claims.

I claim:

1. An apparatus for producing polypropylene yarn comprising a spinneret means having a plurality of openings for melt spinning of a molten polymer composition; vertical shaft means for cooling and solidifying the molten polymer after emergence from said spinneret means to form a plurality of filaments; means to combine said filaments to form at least one multifilament yarn strand; stretching means to substantially orient said filaments of said at least one yarn strand; and winding means; wherein said spinneret means having a sufficient number of openings to form at least 8 yarns, each comprising at least 10 filaments, said vertical shaft means having a length sufficient to provide for a free path length of said filaments after emergence from said spinneret means and prior to first contact with a first mechanical filament-contacting means of at least 2.5 meters; and wherein said stretching means are formed by a sequence of rotating cylinders having substantially parallel axes of rotation arranged to provide for a path length of frictional contact with said yarn strands of from 1 to 6.5 meters and wherein at least 50% of said path length is provided on a total number of from 2 to 6 of said rotating parallel cylinders.

2. The apparatus of claim 1 further comprising a texturizing means arranged downstream of said stretching means and an additional group of rollers for passing said yarn strands from said texturizing means to said winding means.

3. The apparatus of claim 2 wherein said cylinders have diameters of at least 0.3 meters and further including means for maintaining the cylinder surfaces at a substantially constant temperature.

4. The apparatus of claim 3 comprising drive means for rotating a first group of said cylinders at a first common peripheral speed and for rotating a second group of said cylinders at a second common peripheral speed.

5. The apparatus of claim 4 wherein said total number of cylinders is 4 and wherein all of said cylinders have substantially the same diameters.

6. The apparatus of claim 5 wherein any two adjacent cylinders of said stretching means are distanced by at least half the means diameter of said adjacent cylinders.

7. The apparatus of claim 6 further including first and second means for yarn rupture control including first and second means for yarn rupture control positioned near the start and the end of said path length of frictional contact for each of said yarn strands, at least one of said yarn rupture control means comprising a plurality of parallel slots corresponding with the number of yarn strands, said slots being arranged in an elongated slot bar, and an elongated slide bar for commonly lifting said yarn strands from said slots and for commonly re-feeding said yarn strands upon removal of said slide bar.

8. The apparatus of claim 1 further comprising an entangling means arranged downstream of said stretching means and an additional group of rollers for passing said yarn strands from said entangling means to said winding means.

9. The apparatus of claim 8 wherein said cylinders have diameters of at least 0.3 meters and further including means for maintaining the cylinder surfaces at a substantially constant temperature.

10. The apparatus of claim 9 comprising drive means for rotating a first group of said cylinders at a first common peripheral speed and for rotating a second group of said cylinders at a second common peripheral speed.

11. The apparatus of claim 10 wherein said total number of cylinders is 4 and wherein all of said cylinders have substantially the same diameters.

12. The apparatus of claim 11 wherein any two adjacent cylinders of said stretching means are distanced by at least half the main diameter of said adjacent cylinders.

13. The apparatus of claim 12 further including first and second means for yarn rupture control positioned near the respective start and the end of said path length of frictional contact for each of said yarn strands, at least one of said yarn rupture control means comprising a plurality of parallel slots corresponding with the number of yarn strands, said slots being arranged in an elongated slot bar, and an elongated slide bar for commonly lifting said yarn strands from said slots and for commonly re-feeding said yarn strands upon removal of said slide bar.

14. High speed apparatus for producing a plurality of polypropylene filament yarns at an extrusion rate of at least 400 meters per minute, comprising:

a) a spinneret means having a plurality of openings for melt spinning of a molten polymer composition;

b) vertical shaft means for cooling and solidifying the molten polypropylene after emergence from said spinneret means to form a plurality of filaments;

c) means for combining said filaments to form at least one multifilament yarn strand;

d) stretching means for substantially orienting said filaments of said at least one yarn strand; and e) winding means for accumulating said filaments;

wherein said spinneret means has a sufficient number of openings to form at least eight yarns, each yarn comprising at least ten filaments, said vertical shaft means having a length sufficient to provide a free path length of said filaments after emergence from said spinneret means and prior to first contact with a first mechanical filament-contacting means of at least 2.5 meters; and wherein said stretching means are formed by a sequence of rotating cylinders having substantially parallel axes of rotation arranged to provide for a path length of frictional contact with said yarn strands of from 1.0 to 6.5 meters and wherein at least 50 percent of said path length is provided on from 2 to 6 of said rotating parallel cylinders.

15. The apparatus of claim 14 further comprising a texturizing means arranged downstream of said stretching mean and an additional group of rollers for passing said yarn strands from said texturizing means to said winding means.

16. The apparatus of claim 14 wherein said cylinders have diameters of at least 0.3 meters, further including means for maintaining the cylinder surfaces at a substantially constant temperature.

17. The apparatus of claim 14 further comprising drive means for rotating a first group of said cylinders at a first common peripheral speed and for rotating a second group of said cylinders at a second common peripheral speed.

18. The apparatus of claim 14 wherein said number of cylinders is four and wherein all of said cylinders have substantially the same diameter.

19. The apparatus of claim 14 wherein any two adjacent cylinders of said stretching means are distanced by at least half the mean diameter of said adjacent cylinders.

20. The apparatus of claim 14 further comprising first and second means for yarn rupture control positioned near the respective start and the end of said path length of frictional contact for each of said yarn strands, at least one of said yarn rupture control means comprising a plurality of parallel slots corresponding in number with the number of yarn strands, said slots being arranged in an elongated slot bar, and an elongated slide bar for commonly lifting said yarn strands from said slots and for commonly re-feeding said yarn strands upon removal of said slide bar.

21. Apparatus of claim 14 further comprising an entangling means arranged downstream of said stretching means, and an additional group of rollers for passing said yarn strands from said entangling means to said winding means.

22. Apparatus for producing, polypropylene yarns composed of a plurality of continuous and substantially oriented individual filaments by melt spinning and stretching them in an integral process, comprising:

a) means for simultaneously extruding a sufficient number of said individual filaments to form at least 8 continuous filament yarns, each consisting of at least 10 filaments, into an essentially vertical air quenching zone for solidification of said filaments;

b) means for arranging said filaments as a substantially planar array of parallel and mutually distanced yarn strands;

c) means for stretching said filaments to achieve said substantial orientation by passing said yarns, while maintaining them in said array, over peripheral surface portions of a sequence of rotating cylinders each having a diameter greater than about 0.3 meters and all having parallel axes of rotation, each strand being passed over said surface portions along a discrete path which is substantially defined by a plane intersection perpendicularly with the rotation axis of any cylinder; each strand being in frictional contact with said peripheral surface portions for a contact path length of from 1.0 to 6.5 meters; at least 50 percent of said path length of frictional contact being provided on a total number of from 2 to 6 cylinders; and d) means for winding said yarn strands obtained as product yarns at a rate of at least 1000 meters per minute.

23. The apparatus of claim 22 wherein said filaments formed by the extrusion means are passed through a free vertical path including said air quenching zone and extending from a point of extrusion to a point of first contact with a mechanical yarn guiding means, said free path having a length of at least 2.5 meters.

24. The apparatus of claim 22, wherein said filaments formed by the extrusion means are passed through a free vertical path including said air quenching zone and extending from a point of extrusion to a point of first contact with a mechanical yarn guiding means, said free path having a length of less than about 7.5 meters.

25. The apparatus of claim 22 further including means for maintaining the cylinders of the stretching means at an essentially constant elevated surface temperature above about 80 degrees Centigrade.

26. The apparatus of claim 22 further including means for maintaining the cylinders of the stretching means at an essentially constant elevated surface temperature less than about 130 degrees Centigrade.

27. The apparatus of claim 22 wherein a range from about 75 percent to 100 percent of said contact path length is provided on said total number of cylinders and wherein a first group of said cylinders is rotated at a common first peripheral speed while a second group of said cylinders is rotated at a second common peripheral speed.

28. The apparatus of claim 22 wherein 75 to 100 percent of said path length is provided on said cylinders.

29. The apparatus of claim 22 wherein the cylinders are preferably about 0.4 meters in diameter.

30. Apparatus for producing yarns composed of a plurality of continuous and substantially oriented individual filaments by melt spinning and stretching them in an integral process, comprising:

a) means for simultaneously extruding a sufficient number of said individual filaments to form at least 8 continuous filament yarns, each consisting of at least 10 filaments;

b) an air quenching zone for solidification of said filaments;

c) means for arranging said filaments to form a substantially planar array of parallel and mutually distanced yarn;

d) means for stretching said filaments to achieve said substantial orientation by passing said yarns, while maintaining them in said array, over peripheral surface portions of a sequence of rotating cylinders each having a diameter greater than about 300 mm and all having parallel axes of rotation, each yarn being passed over said surface portions along a discrete path which is substantially defined by a plane intersection perpendicularly with the rotation axis of any cylinder; each yarn being in frictional contact with said peripheral surface portions for a contact path length of from 1.0 to 6.5 meters; at least 50 percent of said path length of frictional contact being provided on a total number of from 2 to 6 cylinders; and e) means for winding said yarn obtained as product yarns at a rate of at least 1000 meters per minute.

31. The apparatus of claim 30 wherein said filaments formed by the extrusion means for passed through a free vertical path including said air quenching zone and extending from a point of extrusion to a point of first contact with a mechanical yarn guiding means, said free path having a length of at least 2.5 meters.

32. The apparatus of claim 30, wherein said filaments formed by the extrusion means are passed through a free vertical path including said air quenching zone and extending from a point of extrusion to a point of first contact with a mechanical yarn guiding means, said free path having a length of less than about 7.5 meters.

33. The apparatus of claim 30 further including means for maintaining the cylinders of the stretching means at and essentially constant elevated surface temperature above about 80 degrees Centigrade.

34. The apparatus of claim 30 further including means for maintaining the cylinders of the stretching means at an essentially constant elevated surface temperature less than about 130 degrees Centigrade.

35. The apparatus of claim 30 wherein a range from about 75 a percent to 100 percent of said contact path length is provided on said total number of cylinders and wherein a first group of said cylinders is rotated at a common first peripheral speed while a second group of said cylinders is rotated at a second common peripheral speed.

36. The apparatus of claim 30 wherein 75 to 100 percent of said path length is provided on said cylinders.

37. The apparatus of claim 30 wherein the cylinders are preferably about 0.4 meters in diameter.

38. An apparatus for producing yarn comprising a spinneret means having a plurality of openings for forming a plurality of filaments by melt spinning of a molten polymer composition; vertical shaft means for cooling and solidifying the molten polymer after emergence from said spinneret; means for combining said filaments to form at least one multifilament yarn strand; means for stretching said filaments of said at least one yarn strand to substantially orient said filaments; and means for winding said at least one strand;

wherein said spinneret means has as sufficient number of openings to form at least 8 yarns, each comprising at least 10 filaments, said vertical shaft means being sufficient to provide a free path length at least 2.5 meters of said filaments after emergence from said spinneret means; and said stretching means comprise a sequence of rotating cylinders having a substantially parallel axes of rotation arranged to provide for a path length of frictional contact with said yarn strands of from 10 to 65 meters and wherein at least 50% of said path length is provided on from 2 to 6 of said rotating parallel cylinders.

39. The apparatus of claim 38 further comprising a texturizing means arranged downstream of said stretching means and an additional group of rollers for passing said yarn strands from said texturizing means to said winding means.

40. The apparatus of claim 39 wherein said cylinders having diameters of at least 0.3 meters and further including means for maintaining the cylinder surfaces at a substantially constant temperature.

41. The apparatus of claim 40 comprising drive means for rotating a first group of said cylinders at a first common peripheral speed and for rotating a second group of said cylinders at a second common peripheral speed.

42. The apparatus of claim 41 wherein said number of cylinders is 4 and wherein all of said cylinders have substantially the same diameters.

43. The apparatus of claim 42 wherein any two adjacent cylinders of said stretching means are distanced by at least half the mean diameter of said adjacent cylinders.

44. The apparatus of claim 43 further including first and second means for yarn rupture control positioned near the respective start and the end of said path length of frictional contact for each of said yarn strands, at least one of said yarn rupture control means comprising a plurality of parallel slots corresponding with the number of yarn strands, said slots being arranged in an elongated slot bar, and an elongated slide bar for commonly lifting said yarn strands from said slots and for commonly re-feeding said yarn strands upon removal of said slide bar.

45. The apparatus of claim 38 further comprising an entangling means arranged downstream of said stretching means and an additional group of rollers for passing said yarn strands from said entangling means to said winding means.

46. The apparatus of claim 45 wherein said cylinders have diameters of at least 0.3 meters and further including means for maintaining the cylinder surfaces at a substantially constant temperature.

47. The apparatus of claim 46 comprising drive means for rotating a first group of said cylinders at a first common peripheral speed and for rotating a second group of said cylinders at a second common peripheral speed.

48. The apparatus of claim 47 wherein said number of cylinders is 4 and wherein all of said cylinders have substantially the same diameters.

49. The apparatus of claim 48 wherein any two adjacent cylinders of said stretching means are distanced by at least half the mean diameter of said adjacent cylinders.

50. High speed apparatus for producing a plurality of polymer filament yarns at an extrusion rate of at least 400 meters per minute, comprising:

a) a spinneret means having a plurality of openings for melt spinning of a molten polymer composition;

b) vertical shaft means for cooling and solidifying the molten polymer after emergence from said spinneret means to form a plurality of filaments;

c) means for combining said filaments to form at least one multifilament yarn strand;

d) stretching means for substantially orienting said filaments of said at least one yarn strand; and e) winding means for accumulating said filaments;

wherein said spinneret means has a sufficient number of openings to form at least eight yarns, each yarn comprising at least ten filaments, said vertical shaft means having a length sufficient to provide a free path length of at least 2.5 meters of said filaments after emergence from said spinneret means and prior to first contact with a first mechanical filament-contacting means; and wherein said stretching means are formed by a sequence of rotating cylinders having substantially parallel axes of rotation arranged to provide for a path length of frictional contact with said yarn strands of from 1.10 to 6.5 meters and wherein at least 50 percent of said path length is provided on from 2 to 6 said rotating said parallel cylinders.

51. The apparatus of claim 50 further comprising a texturizing means arranged downstream of said stretching means and a group of rollers adapted to pass said yarn strands from said texturizing means to said winding means.

52. The apparatus of claim 50 wherein said cylinders have diameters of at least 0.3 meters, further including means for maintaining the cylinder surfaces at a substantially constant temperature.

53. The apparatus of claim 50 further comprising means for rotating a first group of said cylinders at a first common peripheral speed and for rotating a second group of said cylinders at a second common peripheral speed.

54. The apparatus of claim 50 wherein said number of cylinders is four and wherein all of said cylinders have substantially the same diameter.

55. The apparatus of claim 50 wherein any two adjacent cylinders of said stretching means are distanced buy at least half the mean diameter of said adjacent cylinders.

56. The apparatus of claim 50 further comprising first and second means for yarn rupture control, positioned near the respective start and the end of said path length of frictional contact for each of said yarn strands, at least one of said yarn rupture control means comprising a plurality of parallel slots corresponding in number with the number of yarn strands, said slots being arranged in an elongated slot bar, and an elongated slide bar for commonly lifting said yarn strands from said slots and for commonly re-feeding said yarn strands upon removal of said slide bar.

57. Apparatus of claim 50 further comprising an entangling means arranged downstream of said stretching means, and an additional group of rollers for passing said yarn strands from said entangling means to said winding means.

* * * * *

UNITED STATES PATENT AND TRADEMARK OFFICE

CERTIFICATE OF CORRECTION

PATENT NO. : 5,076,773

DATED : December 31, 1991

INVENTOR(S) : Paolo Bert

It is certified that error appears in the above-indentified patent and that said Letters Patent is hereby corrected as shown below:

TITLE PAGE:

Abstract, second line from bottom, "poduct" should be --product--.

Column 1, line 5, "Apr. 15, 1988" should be --Apr. 5, 1988--.

Column 2, line 46, "leat" should be --least--; and "675" should be --75--.

Column 3, line 7, "means;," should be --means;--.

Column 5, line 46, delete "way".

IN THE CLAIMS:

Claim 7, column 12, lines 5 and 6, delete "including first and second means for yarn rupture control";

column 12, line 7, after "near the" insert --respective--.

UNITED STATES PATENT AND TRADEMARK OFFICE

CERTIFICATE OF CORRECTION

PATENT NO. : 5,076,773

DATED : December 31, 1991

INVENTOR(S) : Paolo Bert

It is certified that error appears in the above-indentified patent and that said Letters Patent is hereby corrected as shown below:

Claim 12, column 12, line 34, "main" should be --mean--.

Claim 15, column 13, line 8, "mean" should be --means--.

Claim 22, column 13, line 64, "intersection" should be --intersecting--.

Claim 30, column 14, line 58 "intersection" should be --intersecting--.

Claim 31, column 14, line 68, "for" should be --are--.

Claim 33, column 15, line 13, "and" should be --an--.

Claim 38, column 15, line 40, "as" should be --a--.

Claim 50, column 16, line 60, "1.10" should be --1.0--.

UNITED STATES PATENT AND TRADEMARK OFFICE

CERTIFICATE OF CORRECTION

PATENT NO. : 5,076,773

DATED : December 31, 1991

INVENTOR(S) : Paolo Bert

It is certified that error appears in the above-indentified patent and that said Letters Patent is hereby corrected as shown below:

Claim 55, column 17, line 16, "buy" should be --by--.

Signed and Sealed this

Thirteenth Day of July, 1993

Michael K. Kirk

*Attest:*

MICHAEL K. KIRK

*Attesting Officer*

*Acting Commissioner of Patents and Trademarks*